United States Patent [19]

Eddy

[11] 4,282,734

[45] Aug. 11, 1981

[54] STRUCTURE OF TRUING PISTON CYLINDERS

[75] Inventor: George R. Eddy, Coulter, Iowa

[73] Assignee: Century Machine, Inc., Coulter, Iowa

[21] Appl. No.: 9,408

[22] Filed: Feb. 5, 1979

[51] Int. Cl.[3] ..... B21D 22/10

[52] U.S. Cl. ..... 72/54; 72/58; 72/370

[58] Field of Search ..... 72/370, 54, 58

[56] References Cited

U.S. PATENT DOCUMENTS

| | | | |
|---|---|---|---|
| 3,754,430 | 8/1973 | Halstead | 72/370 |
| 3,812,704 | 5/1974 | Kowal | 72/370 |
| 3,981,172 | 9/1976 | Hess et al. | 72/370 |
| 4,005,591 | 2/1977 | Werner | 72/370 |
| 4,134,287 | 1/1979 | Huede et al. | 72/370 |

*Primary Examiner*—Leon Gilden

*Attorney, Agent, or Firm*—Phillip A. Rein

[57] ABSTRACT

This invention is a structure and process of truing piston cylinders. The structure consists of a main mandrel support means to hold a mandrel member therein including (1) a support base means; (2) a piston cylinder support means mounted on the support base means; and (3) a power supply means connected to the support base means and the piston cylinder support means. The piston cylinder support means includes a stationary headstock and a movable tailstock, both supported on the support base means. The stationary headstock and the movable tailstock are operable to hold a piston cylinder to be trued therebetween plus each having a mandrel receiving member. The power supply means is operable to supply fluid under pressure to the stationary headstock and return fluid to a reservoir tank through the movable tailstock. The mandrel member resembles a miniature barrel member having a main body member; a plurality of spaced sizing ring sections about the main body member; a central fluid channel in the main body member and a plurality of fluid bleed holes leading from the central fluid channel to areas between the sizing ring sections. The diameters of the sizing ring sections progressively diminish from the center to outer ends. The pressure fluid is forced through the main channel and the fluid bleed holes to force the mandrel member the length of the piston cylinder to achieve accurate sizing thereof to a desired constant diameter.

The process of truing piston cylinders consists of the steps of (1) holding a piston cylinder to be trued at opposite ends in a fluid sealed manner; (2) placing a mandrel member at one end of the piston cylinder; (3) applying fluid pressure to one of the mandrel member; (4) moving the mandrel member longitudinally of the piston cylinder; and (5) expanding the diameter of the piston cylinder to maximum diameter of the mandrel member.

6 Claims, 5 Drawing Figures

STRUCTURE OF TRUING PISTON CYLINDERS

PRIOR ART

A search of the prior art revealed the following U.S. Pat. Nos.: 3,719,983, 591,871, 1,359,541, 3,621,548, 3,786,720.

The Smith and Kinley, et al. patents teach the use of a broaching tool with successively larger diameter cutting tools to finish the interior diameter of a pipe. No fluid is used to expand pipe or move the tool.

In fact, none of the prior art patents are similar in use and operation to the applicant's invention as set forth herein.

PREFERRED EMBODIMENT OF THE INVENTION

The structure of this invention includes a main mandrel support means to hold and actuate a mandrel member through a piston cylinder to true same. The main mandrel support means includes (1) a support base means; (2) a piston cylinder support means mounted on the support base means; and (3) a power supply means operably connected to the support base means and the piston cylinder support means. The support base means resembles a lathe type base having a tailstock support member at one end thereof. The piston cylinder support means includes a stationary headstock at the other end of the support base means and a movable tailstock mounted on the tailstock support member. Both of the stationary headstock and the movable tailstock have mandrel receiving members to receive the mandrel member therein plus hold opposite ends of the piston cylinder in a sealed manner. The power supply means includes (1) a pump means secured to the support base means; (2) a fluid reservoir means mounted in the support base means; and (3) a fluid control means to interconnect the pump means to (a) the fluid reservoir means, (b) the stationary headstock and (c) the movable tailstock. The pump means includes a pump member having a fluid inlet line connected through a filter member to the fluid reservoir means and a fluid outlet line. The fluid control means includes (1) an inlet control assembly; (2) a drainage control assembly; and (3) a return control assembly. The inlet control assembly includes an inlet line member having an inlet control valve therein and connected at one end to the fluid outlet line of the pump member and at the opposite end to the mandrel receiving member of the stationary headstock. The drainage control assembly includes a drainage line member mounted between the fluid reservoir means and the mandrel receiving member of the stationary headstock. Further, the drainage line member is connected to a drainage control valve and a filter member. The return control assembly includes a return line member mounted between the fluid reservoir means and the mandrel receiving member of the movable tailstock. Also, a filter member and a return control valve are mounted in the return line member.

The mandrel member is of a barrel shape having (1) a main body member; (2) a plurality of stepped sizing ring sections about the periphery of the main body member; (3) a central fluid channel open at a trailing end of the main body member; and (4) a plurality of fluid bleed holes, each extended between respective pairs of said stepped sizing ring sections. The mandrel members can be constructed of any desired diameter having central ones of the sizing ring sections of a predetermined diameter greater than the piston cylinder to be trued. The mandrel member is forced by fluid pressure through the entire length of the piston cylinder to expand same to the desired precision diameter.

The process of truing the piston cylinder is substantially as described above in forcing a mandrel member under high fluid pressure through a piston cylinder to increase the diameter by expansion and not through a metal cutting or machining process.

OBJECTS OF THE INVENTION

One object of this invention is to provide a structure to hold a piston cylinder to be trued by moving an oversized mandrel member through the piston cylinder to expand same.

Another object of this invention is to move a mandrel member having stepped sizing ring sections of decreasing diameters through a piston cylinder to be trued under fluid pressure.

One other object of this invention is to true a piston cylinder to an exact diameter throughout its length by a metal expansion process.

Still, another object of this invention is to provide a process of truing piston cylinders by movement of a stepped mandrel member therethrough under fluid pressure to achieve metal expansion.

One further object of this invention is to provide a structure to true piston cylinders that is simple to use, sturdy in construction and reliable in operation.

A further object of this invention is to provide a process to true piston cylinders that is simple to follow, fast, reliable and produces accurate results.

Various other objects, advantages, and features of the invention will become apparent to those skilled in the art from the following discussion, taken in conjunction with the accompanying drawings, in which:

FIGURES OF THE INVENTION

Figure 1:
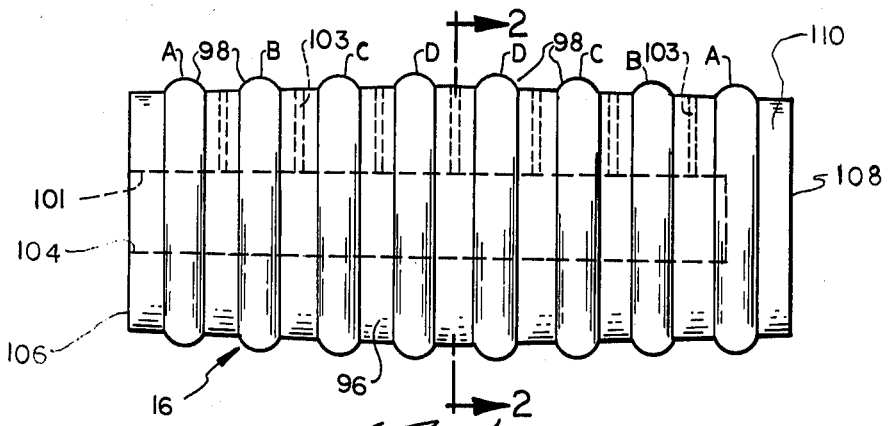
FIG. 1 is a side elevational view of a mandrel member being part of the structure of truing piston cylinders of this invention.

The following is a discussion and description of preferred specific embodiments of the new structure and process of truing piston cylinders of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Figure 4:
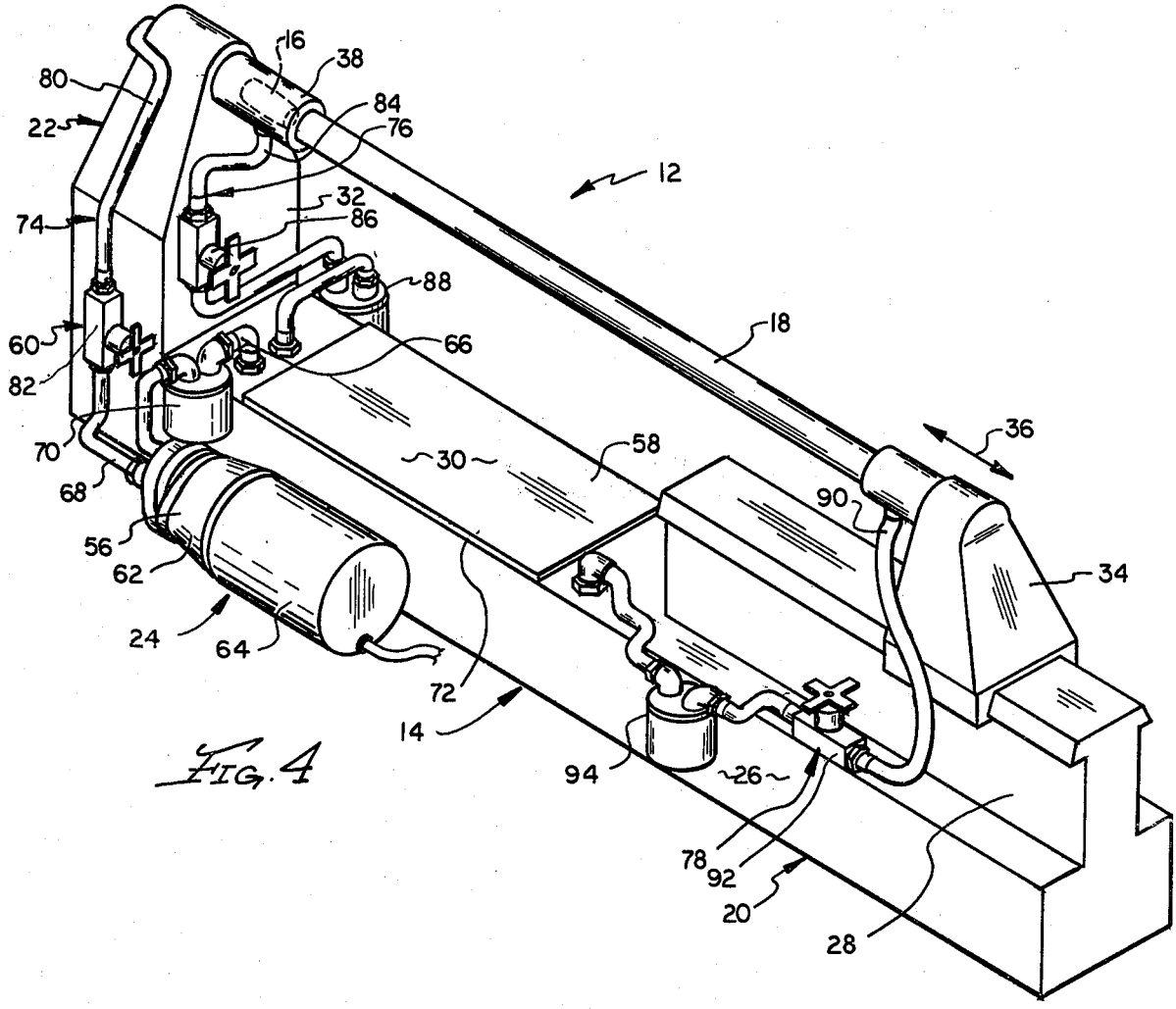
FIG. 4 is a perspective view of the structure of this invention illustrated as holding a piston cylinder for truing of same.

Referring to the drawings in detail and in particular to FIGS. 1 and 4, the structure of this invention, indicated generally at 12, consists of a main mandrel support means 14 operable to hold a mandrel member 16 to be moved under fluid pressure through a piston cylinder 18 to size same by a truing process. The main mandrel support means 14 consists of (1) a support base means 20; (2) a piston cylinder support means 22 mounted on the support base means 20; and (3) a power supply means 24 connected between the support base means 20 and the piston cylinder support means 22.

The support base means 20 resembles a machine lathe type or screw machine structure and includes a main base member 26 of rectangular shape having a tailstock support member 28 secured to one end thereof. The main base member 26 is shown with a lid member 30 which covers a reservoir means to be explained.

As shown in FIG. 4, the piston cylinder support means 22 includes a stationary headstock 32 secured to the other end of the main base member 26 and a movable tailstock 34 mounted on the tailstock support member 28. It is obvious that the movable tailstock 34 is operable to be moved as shown by the arrow 36 in FIG. 4 to accomodate piston cylinders 18 of different lengths.

The stationary headstock 32 includes a mandrel receiver member 38 of cylindrical shape to receive the mandrel member 16 therein as will be explained. The mandrel receiver member 38 is open at an outer end to receive one end of the piston cylinder 18 therein at a stepped portion 40 to receive a gasket member 42 and a groove 44 receives an O-ring member 46. At the other end of the mandrel receiver member 38 is a fluid pressure inlet channel 48 and a discharge line channel 50 for reasons to be explained.

The movable tailstock 34 also includes a mandrel receiver member 52 similar to that described above with an identical stepped portion 40 to receive the gasket member 42 and the O-ring member 46 in the groove 44. The mandrel receiver member 52 is provided with a fluid outlet channel 54 for reasons to be explained.

Figure 5:
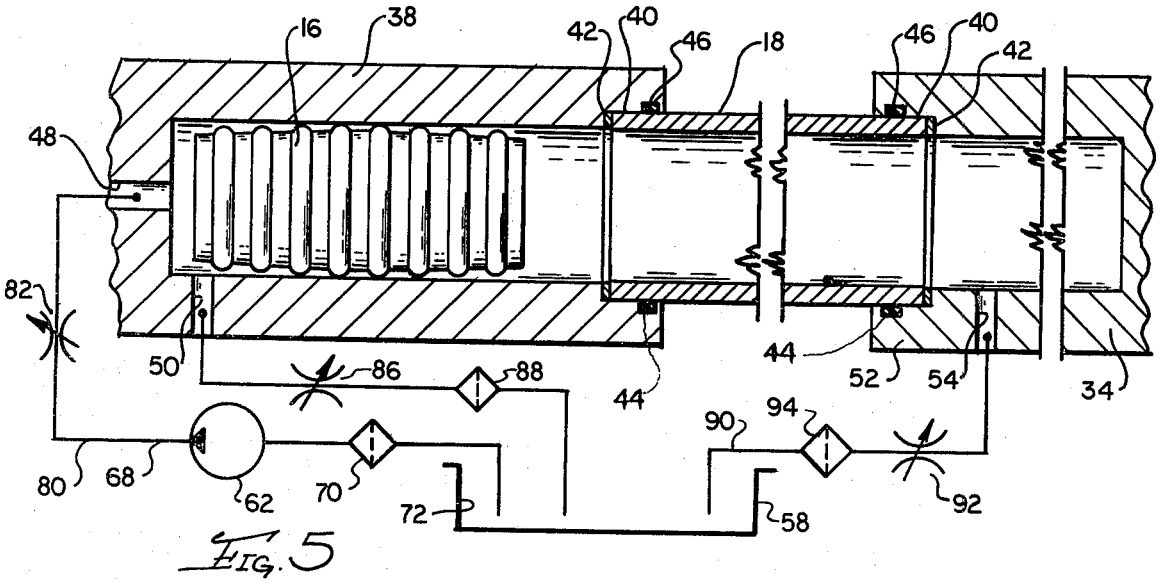
FIG. 5 is a schematic diagram showing the fluid flow and movement of the mandrel member for practicing the process of this invention.

As shown in FIGS. 4 and 5, the power supply means 24 includes (1) a pump means 56 secured to the main base member 26; (2) a reservoir means 58 mounted in the main base member 26 and (3) a fluid control means 60 to interconnect (a) the pump means 56; (b) the reservoir means 58; (c) the headstock mandrel receiver member 38; and (d) the tailstock mandrel receiver member 52.

The pump means 56 includes a pump member 62 driven by a motor member 64 and operable to receive fluid from a fluid inlet line 66 and dispense same through a fluid outlet line 68 under pressure.

The fluid inlet line 66 is connected through a filter member 70 to the reservoir means 58 to supply fluid to the pump member 62.

The reservoir means 58 is built into the main base member 26 and includes a reservoir tank 72 having the lid member 30 thereon.

The fluid control means 60 includes (1) an inlet control assembly 74; (2) a drainage control assembly 76; and (3) a return control assembly 78. The inlet control assembly 74 includes an inlet line member 80 connected to the fluid outlet line 68 on the pump member 62; and inlet control valve 82 mounted on the inlet line member 80; and the outer end of the inlet line member 80 is connected to the inlet channel 48 of the stationary headstock 32.

The drainage control assembly 76 includes a drainage line member 84 mounted between the reservoir tank 72 and the discharge line channel 50 in the stationary headstock 32 plus having a drainage control valve 86 and a filter member 88 mounted in the drainage line member 84.

The return control assembly 78 includes a return line member 90 mounted between the reservoir tank 72 and the fluid outlet channel 54 in the movable tailstock 34 plus having a return control valve 92 and a filter member 94 in the return line member 90.

All of the aforementioned filter members and control valves operate in a conventional manner.

Figure 2:
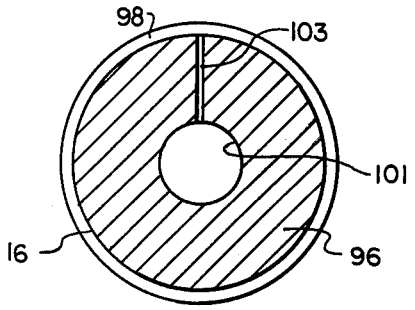
FIG. 2 is a sectional view taken along line 2—2 in FIG. 1.

As shown in FIGS. 1 and 2, the mandrel member 16 includes (1) a main body member 96 of a barrel shape; (2) a plurality of spaced sizing ring sections 98 about the outer periphery of the main body member 96; (3) a central fluid channel 101; and (4) a plurality of spaced, parallel fluid bleed holes 103.

The main body member 96 is of a cylindrical shape being operable to move through the center of a piston cylinder 18.

The sizing ring sections 98 are preferably constructed of a chrome material heat treated to a very hard finish. The sizing ring sections 98 diameters are progressively smaller from the center to the outer ends. For example, the sizing ring sections 98 marked "A" are the smallest with the ones marked "B" the largest and represents the finished trued diameter of the piston cylinder 18. The sizing ring sections 98 marked "B" and "C" are between "A" and "D" and operate to gradually increase the diameter of the piston cylinder 18 being trued.

The central fluid channel 101 is a bore having an opening 104 at a trailing end section 106 and an endwall 108 at a leading end section 110.

Each of the fluid bleed holes 103 extends between adjacent ones of the sizing ring sections 98 to transfer pressure fluid thereto.

USE AND OPERATION OF THE INVENTION

The process of this invention is believed to be fully described by the following description of use and operation of the invention.

The mandrel member 16 of a proper size is placed within the mandrel receiver member 38 of the stationary headstock 32 (FIG. 5).

Next, the piston cylinder 18 to be trued is mounted between the stationary headstock 32 and the movable tailstock 34 (FIG. 1). The gasket members 42 and O-Ring members 46 provide a high pressure fluid seal when the movable tailstock 34 is moved to compress the gasket members 42.

It is noted that the mandrel member 16 is chosen of a slightly larger diameter than the piston cylinder 18 so as to true same to a desired, consistant diameter.

The inlet control valve 82 is opened, the drainage control valve 86 is closed, and the return control valve 92 is opened.

Next, the motor member 64 is energized to operate the pump member 62 to create fluid pressure in the inlet line member 80 through the inlet channel 48 to act against the mandrel member 16. The fluid pressure used is normally in range of 2,000 to 4,000 PSI but preferably of 3,000 PSI. This will vary somewhat on material from which the piston cylinder 18 is constructed.

The leading end section 110 of the mandrel member 16 is the first to enter the smaller diameter of the piston cylinder 18. The fluid pressure is acting to move the mandrel member 16 longitudinally with the piston cylinder 18 being expanded to the diameter of the sizing ring sections 98 marked "A" then to size of "B", "C", and "D". The final diameter of the piston cylinder 18 will be slightly larger than "D" as fluid flow will pass thereover.

Figure 3:
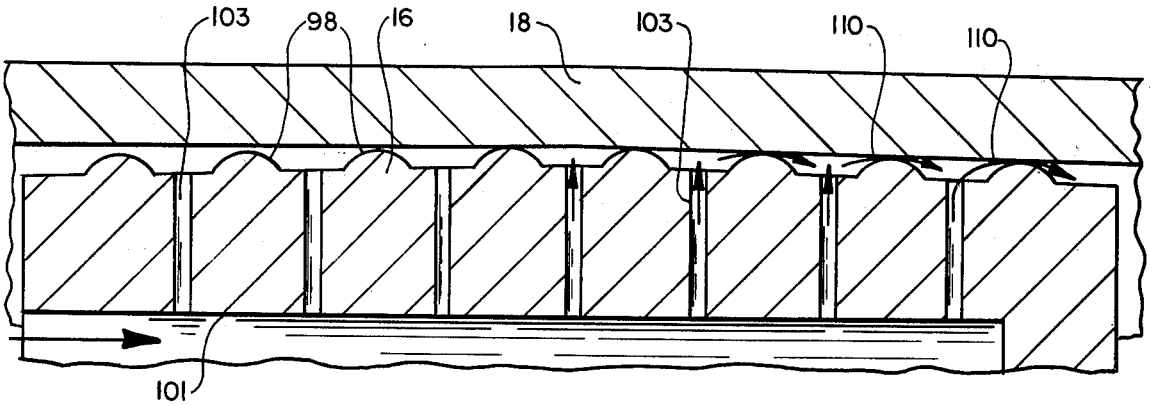
FIG. 3 is a fragmentary sectional view of the mandrel member inside a piston cylinder being trued by the process of this invention.

As the expansion occurs, the pressure fluid weeps over the sizing ring sections 98 as shown by the arrows 110 in FIG. 3. Concurrently with the weeping, the mandrel member 16 moves gradually and longitudinally the length of the piston cylinder 18 to the mandrel receiver member 52 of the movable tailstock 34.

It is obvious that the weeping pressure fluid flows through the return line member 90, the open return control valve 92, and the filter member 94 to the reservoir tank 72.

Next, the fluid in the mandrel receiver member 38 and 52 and in the trued piston cylinder 18 can be removed through the drainage line member 84 to the reservoir tank 72 on opening of the drainage control valves 86.

The mandrel tailstock 34 can be moved outwardly to remove the trued piston cylinder 18. The mandrel member 16 is transferred from the movable tailstock 34 to the stationary headstock 32 and the truing process can be repeated.

It is noted that the structure and process of truing piston cylinders of this invention is simple in operation as using an expansion method and not a machining operation. It provides accurate results as no appreciable wear is encountered on the mandrel member.

The process of truing piston cylinders of this invention is more economical than the present methods, faster than present methods, and produces tolerances superior to other known methods. The process accomplishes superficial finish hardness for improved life of wear surfaces equal to or superior to roller burnishing.

While the invention has been described in conjunction with preferred specific embodiments thereof, it will be understood that this description is intended to illustrate and not to limit the scope of the invention, which is defined by the following claims.

I claim:

1. A structure for truing piston cylinders, comprising:

(a) a mandrel support means including a piston cylinder support means mounted on a support base means, and a power supply means;

(b) a piston cylinder to be trued is mounted on said piston cylinder support means;

(c) a mandrel member is mounted in said piston cylinder support means, said mandrel member having portions thereof of a greater diameter than said piston cylinder;

(d) said mandrel member is forced through said piston cylinder by said power supply means to expand same to a desired trued diameter;

(e) said mandrel member includes a main body having a plurality of spaced sizing ring sections;

(f) said sizing ring sections of sections of progressively increasing diameters so as to progressively increase the diameter of said piston cylinder;

(g) said mandrel member having a leading end and a trailing end;

(h) a central fluid channel resembles a bore extends from said leading end toward said trailing end; and (i) a plurality of fluid bleed holes, each extended between said central fluid channel and pairs of said sizing ring sections.

2. The structure as described in claim 1, wherein:

(a) said power supply means includes a pump member connected to said piston cylinder support means to supply pressure fluid thereto; and (b) said pump member operates to supply pressure fluid against said mandrel member to force same longitudinally of said piston cylinder to expand same.

3. The structure as described in claim 1, wherein:

(a) said sizing ring sections are of progressively large diameters from said leading end toward said trailing end with the largest diameters being at a central portion thereof; and (b) said mandrel member being a free floating member movable longitudinally by the application of pressure fluid there against.

4. A structure for truing piston cylinders, comprising;

(a) a mandrel support means including a piston cylinder support means mounted on a support base means, and a power supply means;

(b) a piston cylinder to be trued is mounted on said piston cylinder support means;

(c) a mandrel member is mounted in said piston cylinder support means, said mandrel member having portions thereof of a greater diameter than said piston cylinder;

(d) said mandrel member is forced through said piston cylinder by said power supply means to expand same to a desired trued diameter;

(e) said mandrel member having spaced sizing ring sections;

(f) said mandrel member having a leading end and a trailing end;

(g) a fluid channel extends from said leading end toward said trailing end; and (h) a fluid bleed hole extends between said fluid channel and said spaced sizing ring sections.

5. The structure as described in claim 4, wherein:

(a) said sizing ring sections of progressively increasing diameter so as to progressively increase the diameter of said piston cylinder.

6. The structure as described in claim 4, wherein:

(a) said power supply means includes a pump member to supply pressure fluid against said mandrel member to force same longitudinally of said piston cylinder to expand same.

* * * * *